US005536991A

United States Patent [19]

Parham et al.

[11] Patent Number: 5,536,991

[45] Date of Patent: Jul. 16, 1996

[54] LAMP HAVING SILICA PROTECTIVE COATING

[75] Inventors: Thomas G. Parham, Gates Mills; Leonard E. Hoegler, Solon; Pamela K. Whitman, Gates Mills, all of Ohio

[73] Assignee: General Electric Company, Schenectady, N.Y.

[21] Appl. No.: 305,002

[22] Filed: Sep. 13, 1994

[51] Int. Cl.[6] ..... H01J 5/16

[52] U.S. Cl. ..... 313/113; 313/580; 313/635

[58] Field of Search ..... 313/113, 635, 313/580; 362/296

[56] References Cited

U.S. PATENT DOCUMENTS

| | | | |
|---|---|---|---|
| 3,959,563 | 5/1976 | Vaughn, Jr. et al. | 428/429 |
| 4,339,686 | 7/1982 | Potter | 313/221 |
| 4,942,065 | 7/1990 | Factor et al. | 427/387 |
| 5,168,193 | 12/1992 | Hoegler | 313/113 |
| 5,276,763 | 1/1994 | Gobel et al. | 313/113 |

*Primary Examiner*—Sandra L. O'Shea
*Assistant Examiner*—Vip Patel
*Attorney, Agent, or Firm*—George E. Hawranko; Stanley C. Corwin

[57] ABSTRACT

An electric lamp, such as an incandescent linear quartz heat lamp, is provided having a vitreous light transmissive envelope having an exterior surface and a light source capable of generating light within said envelope. Disposed on a portion of the exterior surface of the envelope is a diffuse reflective coating, such as a boron nitride coating, for reflecting at least a portion of the light emitted by the source. A protective silica coating encapsulates the reflective coating to protect the reflective coating from things such as abrasion, moisture, and cleaning solvents.

17 Claims, 1 Drawing Sheet

LAMP HAVING SILICA PROTECTIVE COATING

BACKGROUND OF THE INVENTION

1. Field of the Invention

The present invention generally relates to electric lamps, and more particularly, to electric lamps having a diffuse reflective coating and a silica coating for protecting the diffuse reflective coating.

2. Description of Related Art

It is known to use coatings on lamps which reflect various portions of the spectrum of light emitted from the lamp. Heat-resistant diffuse reflective coatings containing a refractory metal oxide such as zirconia, alumina, titania, etc., with a glass frit binder or a binder such as a mixture of boric acid and silica, have been used on the ends of arc tubes of high intensity discharge lamps, such as metal halide arc discharge lamps. See, for example, U.S. Pat. No. 3,374,377, the disclosure of which is expressly incorporated herein in its entirety. The reflective coatings reflect both visible and infrared radiation to maintain a relatively high temperature at ends of the arc tube and prevent ionized metal halides in the arc tube from condensing on otherwise relatively cool ends of the arc tube.

Heat-resistant diffuse reflective coatings comprising boron nitride have also been used on lamps, such as incandescent linear quartz heat lamps. See, for example, U.S. Pat. No. 5,168,193, the disclosure of which is expressly incorporated herein in its entirety. The reflective coating is applied to a portion of the outer surface of the lamp envelope for reflecting both visible and infrared radiation emitted by the filament. Applying the reflective coating on half of the linear surface of the envelope maximizes the radiant energy emitted in the direction of an object to be heated, while minimizing the radiant energy emitted in the opposite direction.

The diffuse reflective coatings or powder coatings are not very durable and typically have a relatively low abrasion resistance. Therefore, lamps having exposed coatings require careful shipping and handling. The diffuse reflective coatings which are water based, such as the boron nitride coatings, are also easily washed off. This is particularly a problem in industrial settings having the potential for condensation to build up when the lamp is cool. The condensation can build up and gradually wash off the diffuse reflective coating. Additionally, in many industrial settings the lamps are cleaned with acetone which washes off the diffuse reflective coating. Accordingly, there is a need for a protective overcoat for diffuse reflective coatings that increases abrasion resistance, increases moisture and acetone resistance, does not degrade the performance of the lamp, is relatively inexpensive to apply, and will withstand the high temperature conditions and thermal cycling experienced on incandescent and arc discharge lamps.

SUMMARY OF THE INVENTION

The present invention relates to an electric lamp having a silica protective coating that overcomes the above-described problems of the related art. According to the invention, the lamp includes a vitreous light transmissive envelope having an exterior surface and a light source capable of generating light within the envelope. Disposed on at least a portion of the exterior surface of the envelope is a diffuse reflective coating for reflecting at least a portion of the light emitted by the source. Disposed on the reflective coating is a protective silica coating to protect the reflective coating.

BRIEF DESCRIPTION OF THE DRAWINGS

These and further features of the present invention will be apparent with reference to the following description and drawings, wherein:

FIG. 1(*b*) is an end elevational view of the lamp of FIG. 1(*a*); and

DETAILED DESCRIPTION OF THE PREFERRED EMBODIMENTS

Figure 1B:
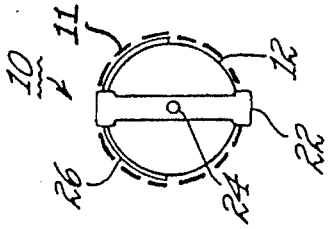
FIG. 1(*a*) is a side elevational view of an incandescent linear quartz heat lamp having an envelope with a diffuse reflective coating and a silica protective coating according to the present invention.
Figure 1A:
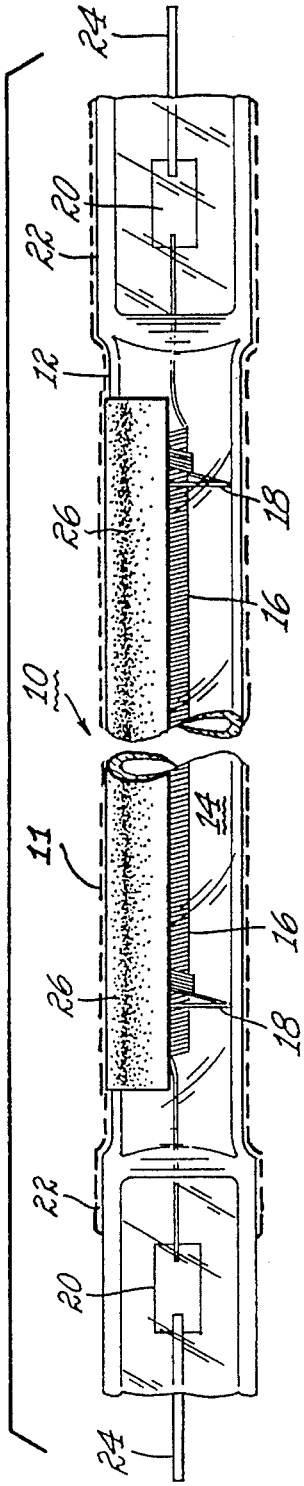

In FIGS. 1(*a*) and 1(*b*) there is schematically illustrated a linear quartz heat lamp 10 having a silica protective coating 11 according to the present invention. The lamp 10 includes a light transmissive envelope 12 which is typically a vitreous material such as quartz or fused silica. The envelope 12 includes a central portion defining a sealed chamber 14 and a press seal portion 22 at each end of the central portion. Hermetically sealed within the chamber 14 is a halogen fill typically comprising krypton and methyl bromide. A coiled tungsten filament 16 is horizontally disposed within the chamber 14 such that a longitudinal axis of the filament 16 is coincident with a longitudinal axis of the chamber 14. The filament 16 is supported within the chamber 14 by means of a plurality of tungsten or tantalum coiled wire filament supports 18. Each end of the filament 16 is welded or brazed to an end of an associated molybdenum foil seal 20. The foil seals 20 are hermetically sealed in the press seal portions 22 of the envelope 12. Lead wires 24 are attached to an end to the foil seals 20 opposite the filament 16 and outwardly extend from ends of the envelope 12.

A diffuse reflective coating 26, such as a boron nitride coating, is disposed on a portion of an exterior surface of the envelope 12. Walls of the envelope 12 typically reach temperatures in the range of about 800 to about 850 degrees centigrade (C) during operation of the lamp which is too high for metal coatings. Slightly less than half of the central portion of envelope 12 is covered by the diffuse reflective coating 26. The diffuse reflective coating 26 substantially reflects the visible and infrared radiation portions of the light emitted by the filament 16. As used in this specification and claims, "light" includes the visible and infrared portions of the spectrum. Using the diffuse reflective coating 26 on generally half or one side of the linear surface of the envelope 12 maximizes the infrared radiation or heat emitted in the direction of an item to be heated while minimizing heat emitted in the opposite direction.

The protective silica coating 11 of the illustrated embodiment is disposed on the diffuse reflective coating 26 and on a substantial portion of the envelope 12 to encapsulate and seal the diffuse reflective coating 26. It is noted that the protective silica coating 11 is only required to be adjacent a substantial portion of the diffuse reflective coating 26. However, the protective silica coating is preferably disposed on the entire exterior surface of the diffuse reflective coating 26, more preferably overlaps edges of the diffuse reflective coating 26 onto the lamp envelope 12, and most preferably is disposed on substantially the entire lamp envelope 12. As used in this specification and claims, "disposed on" contemplates that the coatings may be directly contacting or that there may be intermediate films or coatings such as, for example, a precoat or primer.

Figure 2:
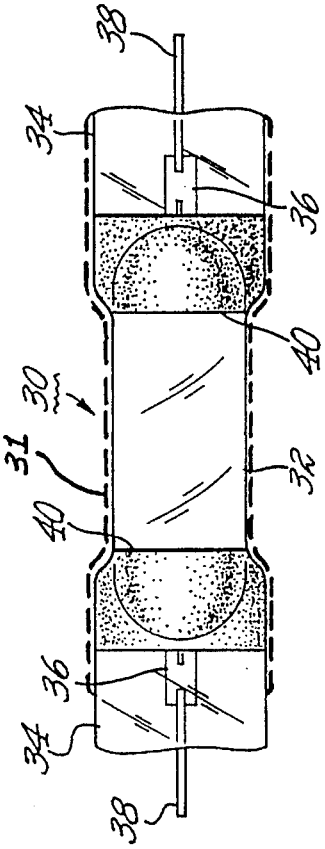
FIG. 2 is a side elevational view of an arc lamp having an arc tube with a diffuse reflective coating and a silica protective coating according to the present invention.

FIG. 2 schematically illustrates an arc lamp 30 having a silica protective coating 31 according to the present invention. The arc lamp 30 includes a light-transmissive vitreous quartz envelope 32 having a central portion defining an arc chamber and a press seal portion 34 at each end of the central portion. Hermetically sealed within the arc chamber is a pair of spaced apart electrodes and an arc sustaining fill comprising one or more metal halides and mercury. It will be noted that the arc lamp could alternatively be an electrodeless arc lamp. Each of the electrodes are welded or brazed to an end of an associated molybdenum foil seal 36. The foil seals 36 are hermetically sealed in the press seal portions 34 of the envelope 32. Lead wires 38 are attached to an end to the foil seals 36 opposite the electrodes and outwardly extend from ends of the envelope 32.

A diffuse reflective coating 40 is disposed on a portion of an exterior surface of the envelope 32. Both ends of the arc chamber, at the transition from the central portion to the press seal portions 34 of the envelope 32, are covered by the diffuse reflective coating 40. The diffuse reflective coating 40 is a coating, such as a boron nitride, aluminum oxide, or zirconium oxide coating, that substantially reflects visible and infrared radiation portions of the light emitted by the arc. The reflected radiation or heat minimizes or avoids condensation of the metal halide at the ends of the arc chamber during operation of the arc lamp 30. It is noted that the diffuse reflective coating 40 could be disposed on other portions of the envelope 32 to direct or reflect radiation emitted by the arc in a desired direction and/or to minimize radiation from being emitted in an undesired direction.

The protective silica coating 31 of the illustrated embodiment is disposed on the diffuse reflective coating 40 and on a substantial portion of the envelope 32 to encapsulate and seal the diffuse reflective coating 40. However, as noted above for the quartz heat lamp 10, the protective silica coating is only required to be adjacent to a substantial portion of the diffuse protective coating 40.

The protective silica coating is preferably a glassy silica which is derived from a coating precursor comprising a liquid dispersion of colloidal silica in a silicone. Silica is used here in a generic sense in that some silicates may also be present. Silicone is also used herein in its generic sense. Alternatively, the protective silica coatings 11, 31 can be any glassy, vitreous, or amorphous silica ($SiO_2$) coating. The glassy silica provides a solid, abrasion resistant, hard, transparent, water and acetone impervious coating that can withstand temperatures up to about 1000 degrees C.

The protective silica coating has been made wherein the silicone of the coating precursor is a water-alcohol solution of the partial condensate of $R(Si(OH)_3)$ wherein R is an alkane, such as methyl trimethoxy silane. Examples of suitable silicones of this type, including some which are disclosed as containing colloidal silica, are disclosed, for example, in U.S. Pat. Nos. 3,986,997, 4,275,118, 4,500,669 and 4,571,365, the disclosures of which are expressly incorporated herein by reference in their entirety. A suitable coating precursor is a silica hardcoat such as Silvue 313 Abrasion Resistant Coating obtained from SDC Coatings Inc., of Garden Grove, Calif. The Silvue 313 is a dispersion of colloidal silica in a solution of a partial condensate of $R(Si(OH)_3)$ wherein R is a methyl group. The dispersion contains 5% acetic acid, 13% n-butanol, 30% isopropanol, 1% methanol (all % by weight), and water. The total solids content of the colloidal silica and methyl trimethoxy silane ranges between 20–25% by weight.

The protective silica coating does not enhance or detract from the performance of the lamp because glassy silica has the same optical transmission characteristics as the quartz envelope. If the protective silica coating develops stress cracking or crazing, however, the performance of the lamp may be detracted. The cracks can cause diffuse scattering that reflects a portion of the heat back into the lamp, Additionally, the silica protective coating may not seal and protect the diffuse reflective coating if cracks are developed.

Stress cracking of the silica protective coating is prevented or minimized by material composition and processing, such as coating thickness, solvent concentrations and drying schedule. It is desirable to have a coating material with a coefficient of thermal expansion closely matching the coefficient of thermal expansion of the item to be coated. In this regard, the protective silica coating closely matches the quartz (fused silica) lamp envelope.

It is also desirable for the protective silica coating to have a thickness effective to both avoid stress cracking and protect the diffuse reflective coating from such things as abrasion, moisture and cleaning solvents. The thickness of the protective silica coating is typically in the range of about 0.1 to about 5 microns. The thickness is preferably in the range of about 0.5 to about 1.5 microns, however, to ease manufacturing of the coated lamps because the processing variables are more critical above or below this range. More preferably, the thickness of the protective silica coating is 1 micron.

To obtain the relatively thin coating, the coating precursor is diluted with solvents, such as butanol (butyl alcohol) and isopropanol (2-propanol). It is believed that other suitable alcohols can be used. A 1 micron thick protective silica coating has been made with a coating precursor solution of 70 cc of butanol and 70 cc of isopropanol added to 60 cc of the Silvue 313. It is believed that other solvent concentrations could be used with a suitable application method and drying schedule to obtain a coating with a suitable thickness to withstand cracking and crazing.

The coating precursor solution is preferably applied to the lamp by dipping the lamp into the solution so that the entire lamp or most of the lamp is covered to fully encapsulate and seal the diffuse reflective coating. The coating precursor solution can be applied to the lamp by other application methods such as, for example, spraying, pouring or brushing.

After the coating precursor solution has been applied to the lamp, it is dried at a low temperature to evaporate the solvents, that is, to drive off the hydrocarbons. The temperature must be high enough to drive off the hydrocarbons but low enough to prevent or minimize reaction of the silicone sol gel, and therefore, should be below 350 degrees C and preferably below 150 degrees C. If the coating precursor solution is heated to an elevated temperature too rapidly the hydrocarbons will be trapped and turn to graphite which results in a darkening or blackening of the coating. Preferably, the coating precursor solution is air dried for about 20 to 30 minutes and then oven dried at 150 degrees C for about 30 minutes.

After the coating precursor solution has been dried at a low temperature, the coating precursor is slowly heated in air to an elevated temperature to "cure" the coating, that is, to drive out or pyrolyze the organics and densify the silica by cross linking the silicone sol gel to form glassy silica. The elevated temperature must be high enough to react the silicone sol gel, and therefore, should be above 350 degrees C. The coating precursor can be heated to the elevated temperature by baking the lamp in an oven, such as at 350 degrees C. for about 30 minutes. When heating the lamp in the oven caution must be taken to ensure that components of the lamp, such as the molybdenum foil seals, are not damaged by the elevated temperature. Alternatively, and preferably, the coating precursor is heated to the elevated temperature by energizing the lamp. The quartz heat lamp, which typically has a temperature of about 600 to about 850 degrees C. at the walls of the envelope during operation, is preferably energized for about 3 to about 5 minutes.

EXAMPLE 1

A coating precursor solution was made by adding 70 cc of butanol and 70 cc of isopropanol to 60 cc of Silvue 313. AGE QH2M T3/CL/HT/R 240 volt Quartz heat lamp having a boron nitride coating was dipped into the coating precursor solution and air dried at room temperature for about 20 to 30 minutes. The coated lamp was then placed in a laboratory oven at 150 degrees C. for about 30 minutes to drive off the solvents. The lamp was then energized for about 3 to 5 minutes to drive off or pyrolyze the organic material and densify the silica to form glassy silica.

The coated lamp was then subjected to running water and was also rubbed with a damp cloth. The boron nitride coating was unharmed by the water or the rubbing. A similar lamp, but not coated with a protective silica coating, was also subjected to running water and rubbed with a damp cloth. The boron nitride coating was substantially removed from the lamp envelope.

EXAMPLE 2

A GE QH2M T3/CL/HT/R 240 volt Quartz heat lamp having a boron nitride coating was prepared in the same manner as described in Example 1. The coated lamp was then rubbed with an acetone damp cloth. The boron nitride coating was unharmed. A similar lamp, but not coated with a protective silica coating, was also rubbed with an acetone damp cloth. The boron nitride coating was substantially removed from this lamp envelope.

The invention has been described with reference to the preferred embodiments. Obviously, modifications and alterations will occur to others upon a reading and understanding of the specification. It is intended to include all such modifications and alterations insofar as they come within the scope of the appended claims or equivalents thereof.

What is claimed is:

1. An electric lamp comprising a vitreous light transmissive envelope having an exterior surface, a light source capable of generating light within said envelope, a diffuse reflective powder coating of boron nitride disposed on at least a portion of said exterior surface of said envelope for reflecting at least a portion of said light emitted by said source, and a protective silica coating disposed on said diffuse reflective coating, said protective silica coating being effective to protect said diffuse reflective coating from detrimental interaction with water.

2. The electric lamp according claim 1, wherein said protective silica coating is a glassy silica.

3. The electric lamp according to claim 2, wherein said protective coating is derived from a coating precursor comprising a liquid dispersion of colloidal silica in a silicone.

4. The electric lamp according to claim 1, wherein said lamp is a quartz heat lamp.

5. The electric lamp according to claim 4, wherein said lamp is an incandescent linear quartz heat lamp.

6. The electric lamp according to claim 5, wherein said protective coating is a glassy silica derived from a coating precursor comprising a liquid dispersion of colloidal silica in a silicone.

7. The electric lamp according to claim 1, wherein said lamp is an arc discharge lamp, said envelope has ends, and said diffuse reflective coating is disposed on the ends of said envelope.

8. The electric lamp according to claim 7, wherein said protective coating is a glassy silica derived from a coating precursor comprising a liquid dispersion of colloidal silica in a silicone.

9. The electric lamp according to claim 1, wherein said protective coating can withstand temperatures up to at least 800 degrees centigrade.

10. The electric lamp according to claim 1, wherein said protective silica coating has a thickness effective for generally avoiding stress cracking and protecting said diffuse reflective coating.

11. The electric lamp according to claim 10, wherein said thickness of said protective silica coating is in the range of 0.1 to 5 microns.

12. The electric lamp according to claim 11, wherein said thickness of said protective silica coating is in the range of 0.5 to 1.5 microns.

13. The electric lamp according to claim 12, wherein said thickness of said protective silica coating is about 1 micron.

14. The electric lamp according to claim 1, wherein said protective silica coating is disposed on substantially the entire diffuse reflective coating.

15. The electric lamp according to claim 14, wherein said protective silica coating overlaps edges of said diffuse reflective coating.

16. The electric lamp according to claim 1, wherein said protective silica coating is disposed on substantially the entire diffuse reflective coating and on substantially the entire exterior surface of said envelope not covered by said diffuse reflective coating.

17. The electric lamp according to claim 1, wherein said protective silica coating encapsulates the diffuse reflective coating.

* * * * *